US007226343B2

(12) United States Patent
Böhler

(10) Patent No.: US 7,226,343 B2
(45) Date of Patent: Jun. 5, 2007

(54) DEVICE FOR ABRASIVE-BLASTING OF WORKPIECES

(75) Inventor: Daniel Böhler, Denzlingen (DE)

(73) Assignee: Gunther Bohler GmbH, Denzlingen (DE)

( * ) Notice: Subject to any disclaimer, the term of this patent is extended or adjusted under 35 U.S.C. 154(b) by 0 days.

(21) Appl. No.: 11/273,547

(22) Filed: Nov. 14, 2005

(65) Prior Publication Data

US 2006/0252357 A1 Nov. 9, 2006

(30) Foreign Application Priority Data

May 9, 2005 (DE) ..... 20 2005 007 320

(51) Int. Cl.
*B24C 3/06* (2006.01)

(52) U.S. Cl. ..... 451/90; 451/87

(58) Field of Classification Search ..... 451/90, 451/102, 87, 88, 89, 99
See application file for complete search history.

(56) References Cited

U.S. PATENT DOCUMENTS 2,305,976 A * 12/1942 McKnight ..... 451/90
2,526,403 A * 10/1950 Paasche ..... 451/90
3,236,459 A * 2/1966 McRitchie ..... 239/416
3,624,966 A * 12/1971 Palmer ..... 451/90
4,048,918 A * 9/1977 Peck ..... 101/114
4,232,487 A * 11/1980 Brown ..... 451/88
4,603,515 A * 8/1986 Gilmore et al. ..... 451/87
4,628,644 A * 12/1986 Somers ..... 451/90
4,646,480 A * 3/1987 Williams ..... 451/87
4,829,724 A * 5/1989 Miller, Jr. et al. ..... 451/99

FOREIGN PATENT DOCUMENTS

AU 166521 * 8/1954 ..... 451/90
DE 1807958 6/1970
DE 3740817 A1 6/1989
GB 0001770 * 12/1982 ..... 451/91

* cited by examiner

*Primary Examiner*—Robert A. Rose
(74) *Attorney, Agent, or Firm*—Tarolli, Sundheim, Covell & Tummino LL

(57) ABSTRACT

A device for abrasive-blasting of workpieces including a chamber (which is to be evacuated during operation) having a first opening, a nozzle pipe unit with a nozzle pipe which can be inserted through the first opening into the chamber, and a container for the accommodation of blasting material, in which case the container for the accommodation of blasting material is mounted, or can be mounted, to the nozzle pipe unit in such a manner that the blasting material can flow freely out of the container into an inlet of the nozzle pipe unit.

11 Claims, 3 Drawing Sheets

DEVICE FOR ABRASIVE-BLASTING OF WORKPIECES

CROSS REFERENCE TO RELATED APPLICATION(S)

The present application claims priority from German Patent Application Number 202005007320.2 having a filing date of May 9, 2005 under 35 U.S.C. § 119.

FIELD OF THE INVENTION

The present invention relates to a device for abrasive blasting, in particular for sand-blasting workpieces, in particular smaller workpieces, for example, in the hobby environment (model construction) or for blasting-work on smaller, limited areas of larger areas, for example, on motor vehicles.

BACKGROUND ART

Devices for abrasive-blasting, for example sand-blasting devices, have been known. Generally, these known devices consist of a blasting material container and an extension pole. In this case, a compressor is used to transport pressurized blasting material, for example, quartz sand, through a hose from the blasting material container to the extension pole in order to be directed at a workpiece to be treated.

These known devices are relatively expensive, in particular because of the necessity of the compressor, so that their use for occasional work such as in the home or hobby environment, for example, in model construction, is not economical.

Furthermore, these devices are generally relatively bulky and, as a rule, cannot be operated at low operating pressure, so that very small components or very small areas cannot be treated in a satisfactory manner. Another disadvantage is that, by using these devices, a large amount of blasting material reaches the environment, which is why their use in the home environment is avoided. Alternately, the blasting material can be trapped by using an additional closed booth, which, however, even further enlarges the system, making it more expensive.

Known devices allow sealing of the area that is to be treated by taping or masking the remaining areas. However, taping causes a relatively abrupt transition at the boundary of the blasted area, in which case said transition must be smoothed first by repeatedly applying and polishing a filler or putty material.

Furthermore, DE 19614555 discloses a device and a method for abrasive-blasting of workpieces, in which case blasting material is transported—by creating a vacuum by evacuating a chamber—from a material storage container through a hose and an extension pole into the chamber, and is blasted onto a small workpiece located in said chamber. The present invention is based on this principle of effects known from the prior art. The disadvantages of this prior art system are the limitations of the working and movement range due to the hose length, and the restricted movement due to the hose that must be carried along, as well as a restriction of size of the workpieces that can be treated if they are to be placed in a circumferentially closed chamber.

SUMMARY OF THE INVENTION

The invention is based on the above-described principle and its object is a device for detailed abrasive-blasting of workpieces which can be implemented in a cost-effective manner and which is easier to handle. In accordance with another aspect of the invention, the device provides the option of treating even small areas on large surfaces.

In accordance with the disclosure, this object is achieved by a device for abrasive-blasting of workpieces including a chamber (which can be evacuated during operation), a nozzle pipe unit with a nozzle pipe which extends into the chamber, preferably in that it can be inserted through a first opening of the chamber, and a container for the accommodation of blasting material, in which case the container for the accommodation of blasting material is mounted, or can be mounted, to the nozzle pipe unit in such a manner that the blasting material can flow out of the container into an inlet of the nozzle pipe unit.

The device of the invention has the advantage that, due to a fixed connection between the blasting material container and the nozzle pipe unit, the hose between the blasting material container and the nozzle pipe unit can be omitted. Inasmuch as the blasting material is transported by the vacuum in the chamber from the container through the nozzle pipe into the chamber, an operator only needs to handle the nozzle pipe unit and, consequently, can move relatively freely. As a result of this, even the treatment of small areas on large surfaces, e.g., in the automobile field for repairing body parts or the working on areas that are difficult to access is easily possible.

In a preferred embodiment the chamber has a second opening, which can be used to attach the chamber on a workpiece to be treated; and an elastic gasket is provided in order to seal the intermediate space between the circumference of the second opening and the workpiece. This embodiment permits the local treatment of small areas on larger surfaces in a very simple manner, because the area to be blasted is limited by the size of the second opening, and the chamber or opening can simply be attached manually to the respective area to be treated. The nozzle pipe, which is inserted into the chamber through the first opening, can be moved inside the chamber and directed at the area enclosed by the second opening.

Additional advantages and features of the exemplary device are described in conjunction with the accompanying drawings. Hereinafter, the invention is explained in detail with reference to the attached drawings.

EXEMPLARY EMBODIMENTS FOR PRACTICING THE INVENTION

Figure 1:
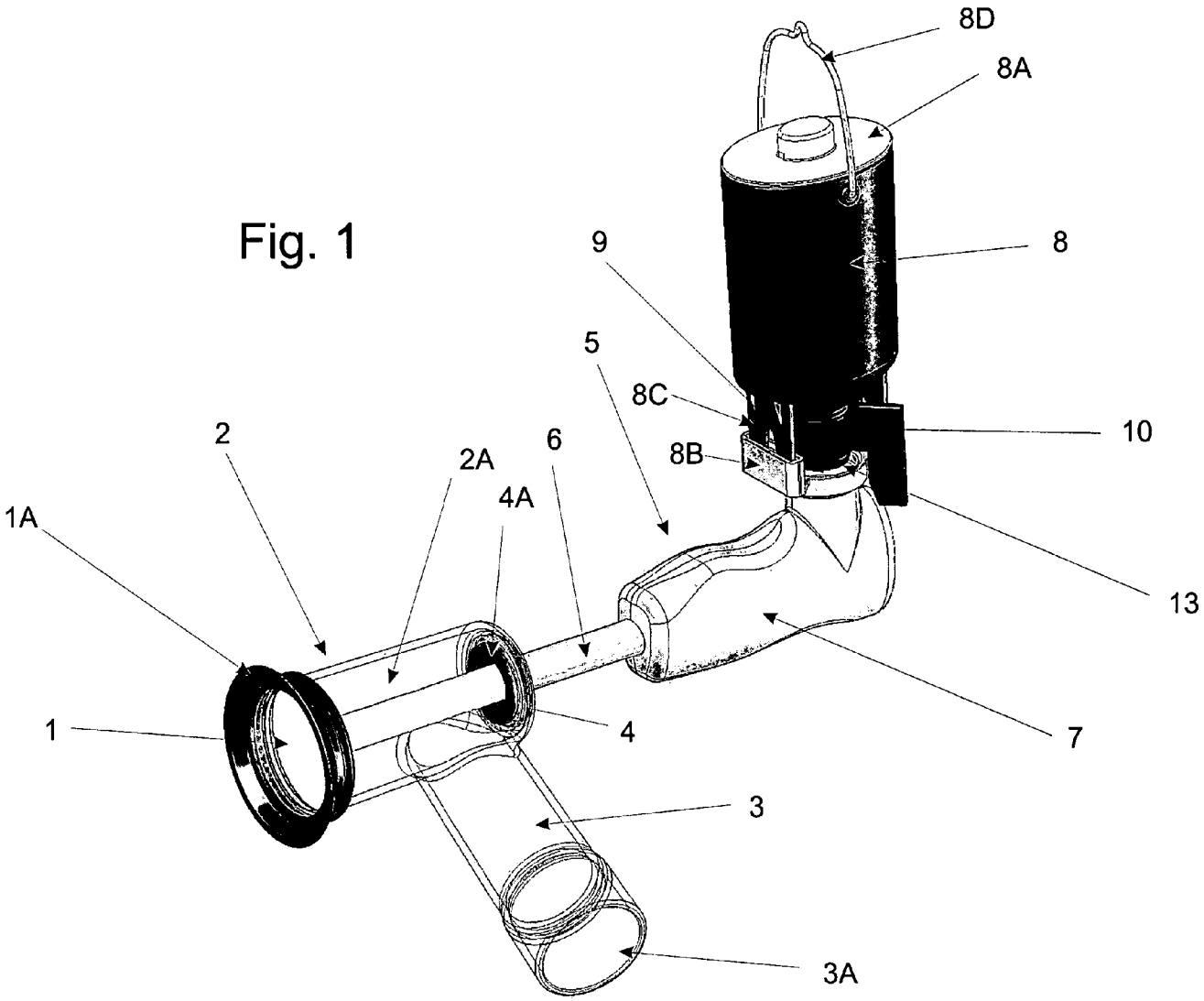
FIG. 1 a perspective illustration of the inventive device, viewed from the front and top.

FIG. 1 shows an embodiment of the device for abrasive-blasting of workpieces, said device including a chamber unit 2, which can be evacuated during operation and has an access opening 4; and a nozzle pipe unit 5 with a nozzle pipe 6, which can be inserted into chamber unit 2 through the access opening 4. Access opening 4 for nozzle pipe 6 is provided with a gasket 4A in order to seal said access opening relative to nozzle pipe 6, when said nozzle pipe is inserted into access opening 4, and in order to allow a rotating and tilting movement of the nozzle pipe, as well as a movement in longitudinal direction. Preferably, an elastic membrane of plastic material or rubber is used as the seal 4A. If the movability of the nozzle pipe 6 is not desired, the nozzle pipe 6 could be rigidly attached or fixed to the chamber unit 2 without a gasket.

The nozzle pipe unit 5 includes a container 8 for the accommodation of blasting material, in which case blasting material container 8 is preferably detachably mounted, or can preferably be detachably mounted, in such a manner that the blasting material can flow freely out of container 8, i.e., essentially due to the effect of gravity, into an inlet 9 on the nozzle pipe unit 5. Garnet sand or any other finely grained material, can be used as the blasting material.

The inlet 9 is located on the upper rear end of a housing 7, which is molded to the external profile in such a manner that it acts as a handle-piece that aids handling by an operator. The rear end of housing 7 of nozzle pipe unit 5 has an air entry opening 11 (FIG. 2), which communicates with longitudinal nozzle pipe 6 extending from the front end of housing 7 and with inlet 9 for the blasting material. This is shown particularly clearly in FIG. 3, which shows a pipe-connecting piece 12 which connects said openings and the nozzle pipe 6 with each other.

In the region of the inlet 9, nozzle pipe unit 5 has a receptacle 8B, by means of which container 8—which has appropriate opposing pieces configured as strips 8C—can be rigidly mounted to nozzle pipe unit 5 in such a manner that an outlet 13 of container 8 is located at a pre-specified distance above the inlet 9. Furthermore, said inlet's diameter is greater than that of the outlet of the container, i.e., its interior is funnel-shaped and provided with a peripherally raised collar or rim in order to reliably guide the blasting material—despite the distance between the outlet and the inlet—into the connecting piece and thus prevent said blasting material from exiting.

In order to adjust and control the amount of blasting material moving through outlet 13, container 8 preferably comprises a metering device 10, which, in a manner known per se, can selectively change or close the diameter of the outlet opening. In a not illustrated modification, the metering device can comprise a lever or button, which can be accessed and actuated by the operator, in which case said lever or button, is pushed or forced by a spring, for example, into a closing position, in which the outlet opening is closed in inoperative mode and is opened only by applying a force and only as long as said force is applied. Furthermore, the container can be closed on its upper end by a removable lid 8A through which filling occurs.

In order to ensure that blasting material flows freely out of the container due to the force of gravity, there must be ideally no negative pressure above the blasting material. Therefore, optionally, vent openings must be provided on the container or lid, so that ambient pressure exists in the container at least above the blasting material. Furthermore, in accordance with the invention, no excess pressure above the blasting material is required to transport the blasting material into the nozzle pipe and further on to the workpiece to be treated. This represents a substantial difference from the prior art, which requires a compressor to create such excess pressure. In accordance with the invention, transport occurs solely due to the effect of the vacuum in the environment of the object to be blasted, i.e., at the exit of the nozzle pipe, through which air is drawn through said nozzle pipe, whereby said air rapidly carries along the blasting material that flows out of the container.

Furthermore, container 8 (as illustrated), or housing 7 of the nozzle pipe unit, comprises a holding device (here configured as a holding bracket 8D) which can be used to suspend the nozzle pipe unit in position with the upright standing container.

In order to be able to see the filling level of material filled into the container, said container may be made completely, or partially, of an at least partially transparent material, or said container may have a window.

In a not illustrated modification, the connection segment between container 8 for the accommodation of blasting material and nozzle pipe unit 5 may have a pivot plane that is inclined, for example, by 45 degrees, relative to nozzle pipe 6, in which said plane container 8 can be rotated or pivoted about a longitudinal axis at an angle relative to nozzle pipe 6. In this modification, nozzle pipe 6 can be inclined relative to the horizontal, while, due to the pivoting action, container 8 can still be positioned substantially vertically due to the inclined plane. In so doing, the blasting material can flow essentially freely out of the container into the inlet, even when the nozzle pipe is inclined. Other angles for the plane are possible in a wide range depending on the particular design. This modification allows the inclination of the nozzle pipe between horizontal and vertical to a certain extent.

In a not illustrated development, the device may be provided with an additional hose, which can be connected on its one end with the nozzle pipe unit and its inlet and which has on its other end an adapter piece with an inlet, which can be coupled with the container removed from the nozzle pipe unit in such a manner that the outlet of the container is positioned at a specific distance above the inlet of the adapter piece, and that the blasting material can flow freely out of the container into the inlet of the adapter piece. The container can then be suspended by the holding bracket at a distance from the nozzle pipe and be connected with the nozzle pipe unit by means of the hose through which the blasting material is supplied. This modification makes particular sense when areas of workpieces are to be treated that are not accessible with the nozzle pipe unit and the blasting material container placed thereon, or when "overhead" work is to be performed and the nozzle pipe unit cannot be held vertically.

The evacuatable chamber 2 has a second, preferably larger, opening 1, which is located approximately opposite access opening 4 for nozzle pipe 6 and which can be used for attaching the chamber to a workpiece to be treated. An elastic gasket 1A for sealing the intermediate space between the circumference of opening 1 and the workpiece is provided on the chamber unit. By providing the seal with a large elastic bead or rim, the chamber unit can still maintain a sealing contact with the workpiece surface despite a certain mobility, thus defining the treatment area. The second opening can, however, be arranged at a different position in relation to the first opening. Also, the first opening and the gasket can be avoided if the nozzle pipe is rigidly connected or attached to the chamber wall and extends into the chamber.

Additional openings can be provided so as to be selectively sealed for allowing access to the interior of the chamber with a tool or a holding device, for example a tweezer, or for providing plural access options for the nozzle pipe 6.

Figure 2:
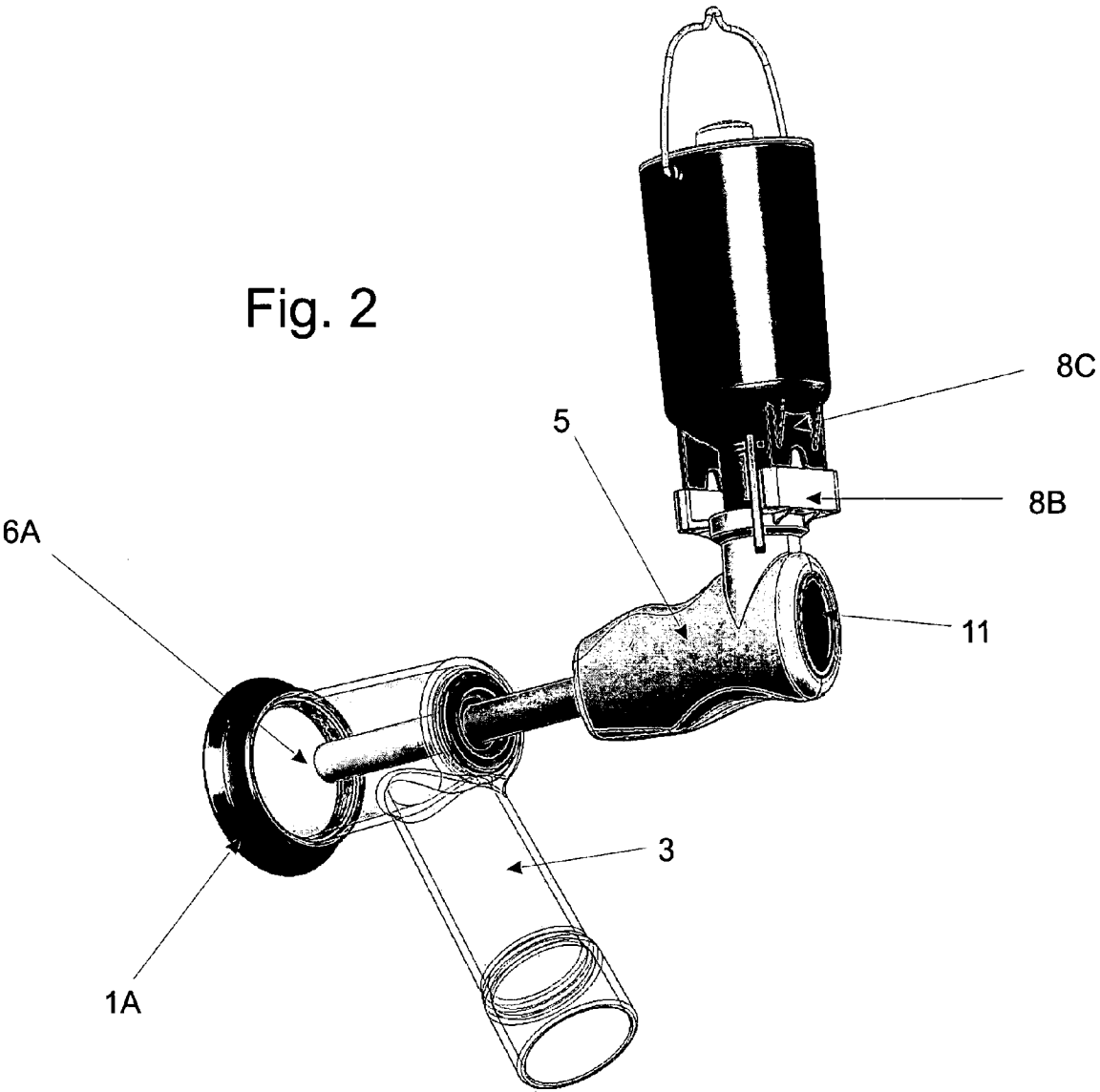
FIG. 2 a perspective illustration of the inventive device, viewed from the back and top; and, FIG. 3 a side elevation of an illustration, partially in section, of the nozzle pipe unit of the inventive device.
Figure 3:
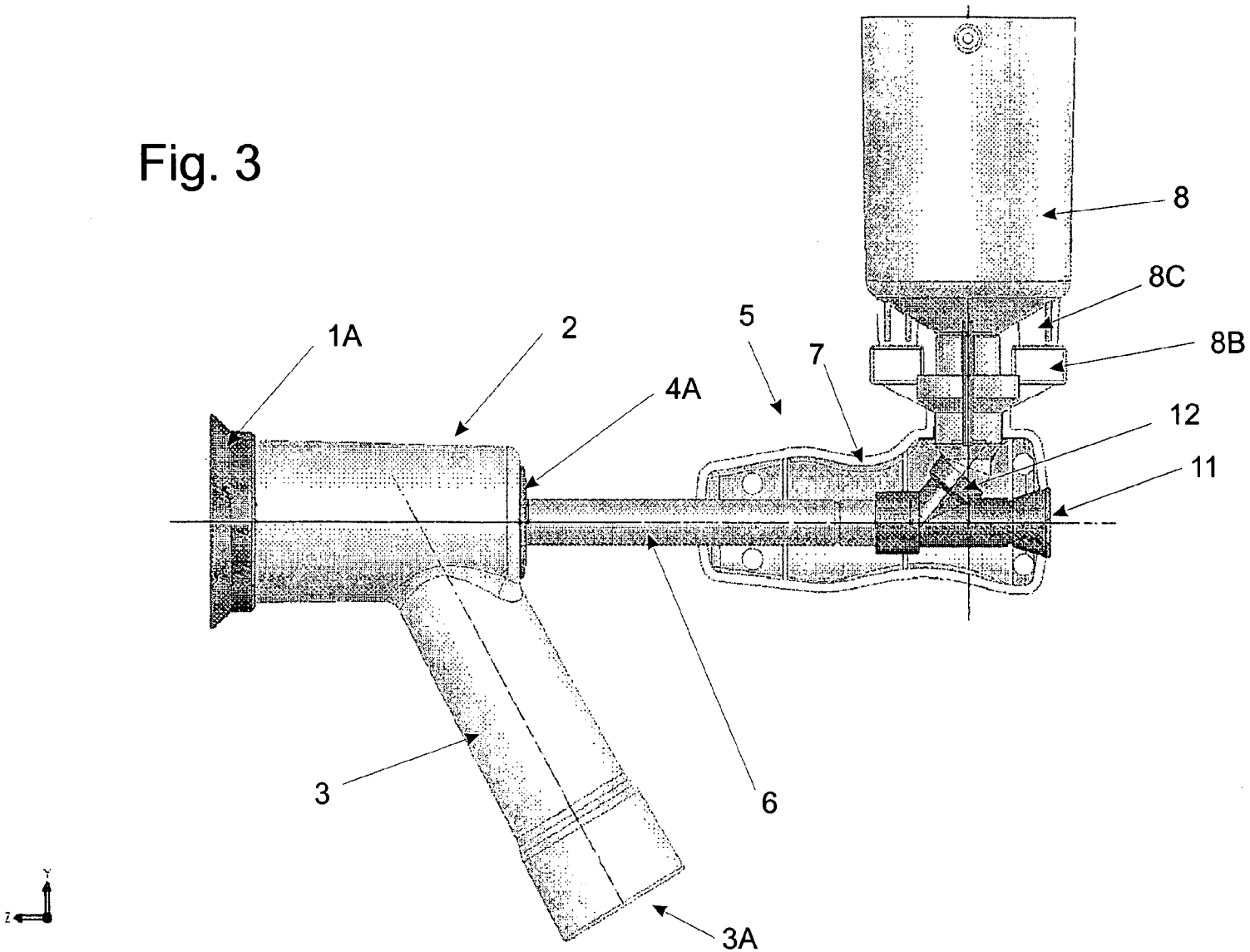

As shown by FIG. 1 and FIG. 2, chamber unit 2 has an additional, third, opening 3A for the connection of an arrangement for evacuating air from blasting chamber 2A in order to create in said chamber the negative pressure required for operating the device. Opening 3A may have the shape of a sleeve of a hose with, or without, an additional connection system for holding a hose in place, for example, a connector or a locking device such as a bayonet or locking connection. In the case of the shown embodiment, in which opening 3A is provided on the end of a pipe-connecting piece 3 extending from blast chamber 2A at an angle, it is particularly advantageous to have the option of using the pipe-connecting piece as a handle for holding the chamber unit which can then be used easily by hand. In a particularly preferred embodiment, this pipe or pipe-connecting piece 3 is designed in such a manner that a commercially available vacuum cleaner, optionally with the use of an intermediate element and/or adaptor piece and/or a connection hose, can be attached to the pipe connecting piece 3.

Chamber unit 2 may be made of any material such as metal or plastic material and in any shape, as long as the entire design will withstand the expected negative pressure inside blasting chamber 2A and the abrasive effect of the used blasting material to the extent that this is desired. The manufacture of a preferably one-piece extrusion-molded plastic component (with the exception of the gaskets) is suggested to achieve cost-effectiveness. Furthermore, the use of a transparent plastic material at least for some parts of the chamber unit is advantageous because an observation of the working area during operation is ensured on all sides, without requiring the removal of the chamber unit from the treatment site. Alternatively, if an opaque or less transparent material is used, one or more windows can be provided. Different materials or components could be combined to form the chamber unit by mounting or integrated by co- or integrative molding.

The generation of a vacuum in blasting chamber 2A is possible when treatment opening 1 of chamber unit 2 is attached to a surface while a seal is created by means of gasket 1A, when nozzle pipe 6 is inserted through access opening 4, and outlet opening 6A is located on nozzle pipe 6 for the blasting material inside blasting chamber 2A, and when the evacuating device is working and evacuating air from the interior space of blasting chamber 2A. However, it is not necessary for the chamber to be completely hermetically sealed. Important is such a seal that allows a still sufficient negative pressure due to evacuation on the inside of blasting chamber 2A during operation. During operation, surrounding air is sucked in through air inlet opening 11 of the nozzle pipe unit and transported through nozzle pipe 6 into blasting chamber 2A. In so doing, the action of the negative pressure in blasting chamber 2A also causes the blasting material, which falls out of the container 8 through inlet 9 into the nozzle pipe unit by gravity, to be carried, together with the air, through the nozzle pipe into the interior space of blasting chamber 2A, and to be expelled there through exit opening 6A. In order to achieve a satisfactory evacuation of the blasting material, the pipe segment of connecting piece 12 leading to inlet 9 is installed preferably at an acute angle relative to the longitudinal or air-flow direction.

By appropriately directing the nozzle pipe unit, the workpiece located in the chamber, or the treatment site defined and bordered by treatment opening 1, can be treated in a targeted manner. By changing the evacuating power, the blasting power can be varied in a simple manner. During the evacuation and the generation of a negative pressure, the spent blasting material is evacuated at the same time, so that no further additional evacuation as used in conventional blasting systems—which operate with excess pressure or compressed air as the transport medium for the blasting material—is necessary.

While the present invention has been described with a degree of particularity, it is the intent that the invention include all modifications and alterations from the disclosed design falling within the spirit or scope of the appended claims.

The invention claimed is:

1. A device for abrasive-blasting of workpieces, comprising a chamber unit with a blasting chamber including an opening for connecting a device for the evacuation of air from said blasting chamber in order to create in said blasting chamber a negative pressure, a nozzle pipe unit including a nozzle pipe which extends into the blasting chamber, and a container for the accommodation of blasting material, in which case the container for the accommodation of blasting material is mounted to the nozzle pipe unit in such a manner that said blasting material can flow out of the container into an inlet of the nozzle pipe unit;

wherein the nozzle pipe unit has an air inlet opening for ambient air, and the nozzle pipe communicates with the air inlet opening and with the inlet for the blasting material.

2. The device for abrasive-blasting of workpieces in accordance with claim 1, wherein the blasting chamber has at least one first opening, and the nozzle pipe can be inserted through the at least one first opening into the blasting chamber.

3. The device for abrasive-blasting of workpieces in accordance with claim 1 wherein the nozzle pipe unit comprises a receptacle, which removably affixes the container to the nozzle pipe unit in such a manner that an outlet of the container for the blasting material is located above the inlet.

4. The device for abrasive-blasting of workpieces in accordance with claim 1 wherein the blasting material container comprises a metering unit for adjusting the amount of blasting material that exits through the outlet.

5. The device for abrasive-blasting of workpieces in accordance with claim 1 wherein the blasting chamber has a second opening which is used to attach the chamber unit onto a workpiece that is to be treated, and further wherein an elastic gasket is used for sealing the intermediate space between the circumference of the second opening and said workpiece.

6. The device for abrasive-blasting of workpieces in accordance with claim 2 wherein the blasting chamber has a second opening which is used to attach the chamber unit onto a workpiece that is to be treated, and further wherein an elastic gasket is used for sealing the intermediate space between the circumference of the second opening and said workpiece.

7. The device for abrasive-blasting of workpieces in accordance with claim 1, wherein the opening for the connection of the evacuation arrangement is provided on a pipe-connecting piece protruding from chamber unit, said pipe-connecting piece also acting as a handle for the chamber unit.

8. The device for abrasive-blasting of workpieces in accordance with claim 2 wherein a gasket is provided on the first opening for the nozzle pipe in order to create a seal with respect to the nozzle pipe when said nozzle pipe is inserted into the first opening.

9. The device for abrasive-blasting of workpieces in accordance with claim 1 wherein the chamber unit is at least partially made of a transparent plastic material.

10. The device for abrasive-blasting of workpieces in accordance with claim 1 wherein the container for the accommodation of blasting material is releaseably mounted to the pipe nozzle unit.

11. The device for abrasive-blasting of workpieces in accordance with claim 1 wherein the negative pressure in the blasting chamber is created so that, in operation, air that is sucked in from the ambience through the air inlet opening of the nozzle pipe unit, flows through the nozzle pipe into the interior space of the blasting chamber together with blasting material, which flows out of the container into the nozzle pipe unit, to be expelled from the exit opening of the nozzle pipe.

* * * * *